US007255566B2

(12) United States Patent
Galbraith Coates

(10) Patent No.: US 7,255,566 B2
(45) Date of Patent: Aug. 14, 2007

(54) WRITE-ON WIPE-OFF BOOK HOLDER

(75) Inventor: Barbara Ann Galbraith Coates, 9 Harrison Ct., West Paterson, NJ (US) 07424

(73) Assignee: Barbara Ann Galbraith Coates, West Paterson, NJ (US)

( * ) Notice: Subject to any disclaimer, the term of this patent is extended or adjusted under 35 U.S.C. 154(b) by 403 days.

(21) Appl. No.: 10/905,703

(22) Filed: Jan. 18, 2005

(65) Prior Publication Data

US 2005/0136390 A1 Jun. 23, 2005

Related U.S. Application Data

(63) Continuation-in-part of application No. 10/737,829, filed on Dec. 18, 2003, now abandoned.

(51) Int. Cl.
*B43L 1/00* (2006.01)

(52) U.S. Cl. ..... 434/408

(58) Field of Classification Search ..... 434/85, 434/87, 88, 365, 38, 370, 408, 416, 422, 434/427, 430; 281/45, 48; 40/661
See application file for complete search history.

(56) References Cited

U.S. PATENT DOCUMENTS 5,007,192 A * 4/1991 Hochberg ..... 40/661
5,110,295 A * 5/1992 Concra ..... 434/88
5,219,437 A * 6/1993 Moor et al. ..... 281/29
5,409,383 A * 4/1995 Mannino ..... 434/414
5,599,189 A * 2/1997 Kees ..... 434/370
5,655,323 A * 8/1997 Lassoff ..... 40/611.1
5,827,072 A * 10/1998 Neufer et al. ..... 434/416
5,876,143 A * 3/1999 Ong ..... 402/3
6,199,816 B1 * 3/2001 Case ..... 248/460
6,241,528 B1 * 6/2001 Myers ..... 434/408
6,637,774 B2 * 10/2003 Gaska ..... 281/45
6,866,516 B2 * 3/2005 Smith et al. ..... 434/408

* cited by examiner

*Primary Examiner*—Kurt Fernstrom

(57) ABSTRACT

An educational device that makes printed material, in the form of a child's workbook of varying thickness in the open reading position, or sheet material in the form of a worksheet, or blank template reusable. Children view their work through the clear transparent cover of the apparatus and record answers using a dry erase marker or wipe-off crayon. When completed, answers easily wipe away, allowing for exercises to be repeated many times until mastery. Additionally, the device is convenient, quick, simple, and easy to utilize, especially for young children. It is easily transportable and has multiple functionality, including an additional work, therapeutic, play, or display surface.

20 Claims, 3 Drawing Sheets

WRITE-ON WIPE-OFF BOOK HOLDER

CROSS-REFERENCE TO RELATED APPLICATIONS

This application is a continuation in part (CIP) of parent U.S. patent application Ser. No. 10/737,829 filed Dec. 18, 2003 now abandoned of which the priority is claimed.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates generally to educational devices, and more specifically to a reusable write-on wipe-off book holder for teaching young children. The apparatus, when used in conjunction with any ordinary school workbook, worksheet, or blank template, will allow children, especially young children, children with learning disabilities and children with limited writing and fine motor skills, to repeatedly practice a wide range of learning skills in any subject. In addition, the write-on wipe-off book holder can also be used for therapeutic or recreational activities including coloring and 'paper and pencil' type games.

Workbooks are well known in the educational field. A seemingly unlimited variety of workbooks have been developed to aid in teaching children mathematics, handwriting, language, science, social studies, music, grammar, etc. Such workbooks are valuable instructional tools because they cover a wide range of learning skills, they provide a diversity of formats, and because exercises are typically sequenced from easiest to more difficult. Also, the exercises in typical school workbooks are generally enriched by fun drawings, colors, and interesting formats.

However, exercises in conventional workbooks that use a paper and pencil approach, can only be used once. There is only one chance to fill in each page and complete the assignment. There is no opportunity for repeated practice of any particular page. Making multiple copies of the same page from which to practice becomes, inconvenient, impractical, costly, and in some cases, not an option due to copy written materials.

Write-on wipe-off books, boards, and mats are also common in the educational field. The user is able to write on the coated surface and thereafter wipe off the markings for repeated use. Such devices, however, have a fixed, specific content and are limited in the versatility of the device.

In prior art, devices are known wherein a clear overlay is placed over an underlying paper form whereby a child can write on the clear overlay using the underlying paper form as a guide. The clear overlay may then be erased, and the paper form may be reused. However, devices such as these, as presented in U.S. Pat. Nos. 5,741,561, 3,553,864, and 4,968,258, for example, which utilize plates, plexiglass, and the like, are limited in use and can only accommodate an underlying paper guide in the form of sheet material such as a worksheet.

Other such devices, such as those presented in U.S. Pat. Nos. 5,409,383, 5,409,383, 6,199,816 B1, for example, although more versatile, are deemed to be of substantial height. The height of these devices is not ergonomically practical for use on a desk or tabletop or for young children who are still learning the proper writing posture (i.e. proper hand, wrist, forearm placement) as well as proper "pencil grip".

Other prior art devices, such as presented in U.S. Pat. No. 5,007,192, for example, have required mechanical means such as plates, spring clips, clamps, clipping mechanisms, and the like, to hold the device and or the underlying paper guide in place. These moving parts, when opened and shut, are disruptive in the classroom and are difficult for small children to operate. With these devices, inserting and removing the underlying paper guide, in the form of a worksheet, is cumbersome and time consuming in a classroom or instructional setting and is also difficult for young small children to utilize.

Furthermore, while write-on wipe-off learning devices of prior art are suitable for their intended purposes, these teaching aids do not allow for a variety of work surfaces in one apparatus for use in conducting various teaching, recreational or therapeutic activities. Although more than one work surface is often needed to better illustrate lessons taught in school workbooks, there have been no adequate devices for presenting the workbook material along with additional work or display surfaces for use as teaching aids, or to present alternate communication means or motivational reinforcements, or to remind students of training schedules, particularly learning disabled children.

An improvement over the presently known write-on wipe-off educational devices would comprise of an ergonomic, reusable, write-on wipe-off learning device able to accommodate multiple forms of underlying printed matter including a worksheet, a blank template, and a school workbook being of varying thickness in the open reading position, whereby children are able to write on the clear transparent overlay of the device and easily wipe away their work, allowing for repeated practice and opportunities to learn. Such a device would be quick, simple, and easy to utilize, especially for young children. Additionally, the easily transportable teaching apparatus would have multiple functionality including; an additional work or play surface. This present invention is directed to such an advance in the art.

BRIEF SUMMARY OF THE INVENTION

The present invention is a reusable write-on wipe-off educational device for children, especially young children, children with learning disabilities, and children with limited proficiency in writing and/or workbook skills. It allows children to practice a wide range of academic skills when used in conjunction with printed matter in the form of a child's workbook in the open reading position being of varying thickness, a worksheet, or a blank template. It is a versatile, convenient, cost effective, timesaving tool that allows an instructor or teacher to use the same workbook many times over, either with the same student or with many different students. The present invention is quick, simple, and easy to utilize, especially for young children. Additionally, the present, easily transportable, teaching apparatus has multiple functionality including an additional work or play surface, storage accessories, and ancillary learning packages. As a result, the present invention has several objectives and advantages:

It is an objective of the present invention to provide a wipe-on wipe-off learning device that has multiple functionality to accommodate various underlying printed matter in the form of sheet like material, (i.e. a worksheet, a blank template, a card) or in the form of a child's workbook being of varying thickness in an open reading position. The present device will accommodate all such said printed matter being of any length and of any width up to the fixed length and fixed width of the device itself. Printer matter, in the form of child's workbook in the open reading position deemed 'thick' or 'thin', or sheet material such as a single worksheet, blank template, or card can be used interchangeably with the present device with ease.

Another objective of the present invention is to be able to support and hold a workbook in the open reading position for easy, hands free reading and writing (i.e. marking), whereby both facing pages of a workbook can be viewed and worked on simultaneously. The holder may be placed on a desk or table in front of the user or, due to its rigid supporting structure, may be placed and used on the lap.

It is another objective of the present invention, when used in conjunction with printed matter in the form of a child's workbook, worksheet, or blank template, to provide an educational device that makes such underlying printed matter reusable. After the student records his or her answers on the clear transparent surface cover of the apparatus using a dry erase marker or wipe-off crayon, all the answers can be easily wiped away using a cloth. This permits repeated use of the same workbook page while the original workbook, original worksheet, or original blank template remains protected and in tact. Additionally, this affords educators, therapists, home-schoolers and teachers, the ability use the same underlying printed matter many times over, with either the same student or with many different students, without having to purchase or make multiple copies of the same printed materials.

It is another objective of the present invention to allow for workbook related activities to be repeated many times until mastery. Through the use of this invention, in conjunction with any child's workbook, a student has the means to practice the same activities on a particular page over and over again until the targeted skill is mastered. This is of particular importance for children with learning disabilities as practice facilitates learning and skill mastery.

It is a further objective of the present invention to allow students to record their answers on the clear transparent surface cover of the apparatus using a dry erase marker. This provides students who have limited writing skills and/or limited fine motor control an easier and more successful method of recording their answers since less fine motor coordination is required than with traditional paper and pencil. Some children prefer using markers of different colors rather than a pencil. By allowing the use of color, children may find the learning experience to be more satisfying than traditional pencil and paper, which may motivate them to spend more time practicing their schoolwork.

It is yet another objective of the present educational teaching device to be ergonomically practical for use on a desk or table top, especially for young children who are still learning the proper writing posture (i.e. proper hand, wrist, forearm placement) as well as proper "pencil grip". The height of the present invention is deemed insignificant and will not interfere with proper writing posture and proper "pencil grip" when used on a desk or tabletop. This is of particular importance when teaching young children proper penmanship and early handwriting shills.

Another objective of the present device is to provide a write-on wipe-off book holder that is free of mechanical parts including clasps, clips, and plates to hold the underlying printed matter in place. Printed matter, in the form of a child's workbook in the open reading position, a worksheet, or a blank template, is simply inserted into the opening of the device. It is then ready for use. This method of preparing the printed matter for use is simple, quick, and very easy to use for young children.

Another objective of the present invention is to have an additional work or play surface located on the backside of the device for educational, therapeutic or recreational use. More than one work surface is often needed to better illustrate lessons, or in the case of children with learning disabilities, to present alternate communication means or to remind students of training schedules and reinforcements.

Further objectives and advantages of the invention are to provide an educational device, which is easily transportable, economical and simple to produce, highly effective in its utility, easy to use by children, versatile, and reusable. Each of these objectives will be apparent from the description herein.

In accordance with certain of its aspects, this invention relates to a reusable educational device for children, especially for young children, children with learning disabilities, and children with limited proficiency in the language of instruction to practice a particular subject in conjunction with any existing workbook comprising:

An envelope like device having a top and bottom surface, said top surface comprising of a clear transparent vinyl material, and said bottom surface comprising of a flat rigid fabric-encased supporting board, wherein said top and bottom surfaces are of the same oblong size and peripherally attached together on three of four edges creating an unattached opening on one side allowing for insertion of underlying printed matter in the form of sheet material or a child's opened workbook. A secondary work, play or therapeutic surface is located on the reverse back surface of the device.

While the invention is illustrated and described in a preferred embodiment, the device may be produced in different sizes, configurations, forms, and materials.

BRIEF DESCRIPTION OF THE SEVERAL VIEWS OF THE DRAWINGS

The present invention may best be understood with reference to the following description, taken in connection with the accompanying drawings. While the invention is illustrated and described in a preferred embodiment in FIGS. 1, 1A, and 2, the device may be produced in different sizes, configuration, forms and materials.

DETAILED DESCRIPTION OF THE INVENTION

Figure 1:
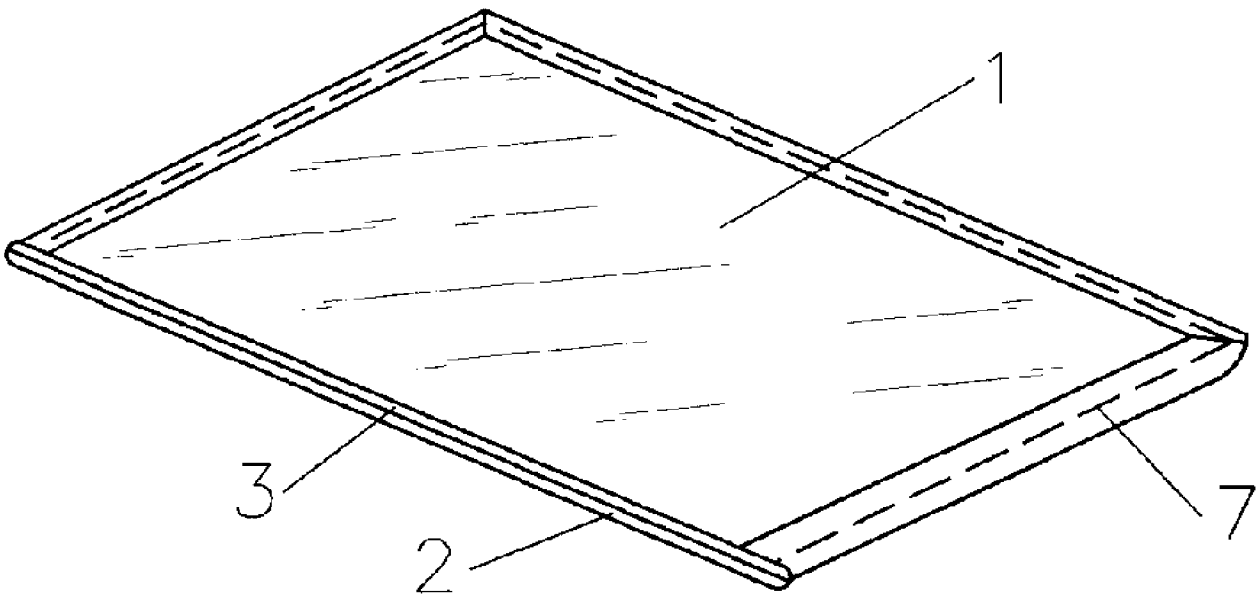
FIG. 1 illustrates the front of the write-on wipe-off book holder in a preferred embodiment

Referring to FIG. 1, in the preferred embodiment, the write-on wipe-off book holder is a rectangular shaped envelope-like apparatus consisting primarily of a top surface (1) of a clear transparent pliable vinyl material peripherally attached on three edges to a flat rigid supporting bottom surface being a fabric encased board (2). Underlying printed matter in the form of either sheet material, such as a worksheet or a blank template, or a child's workbook, being of varying thickness in the open reading position, can be easily inserted and then viewed between the two surfaces (3) of the invention whereby children are able to write on the clear transparent overlay (1) of the device using said underlying printed matter as a guide, and easily wipe away their work, allowing for repeated practice and opportunities to learn. The reverse backside of the device offers an additional therapeutic, work, or play surface such as a flannel felt board, a magnetic board, a 'hook and loop' board, a pocket board, or a plurality of clear transparent cardholding strips for use with material such as flash cards and the like, a display panel bearing indicia, or any combination thereof. Additionally, the present device is easily transportable and may consist of a handle for carrying, a loop for hanging, a removable storage pouch, and may be offered with ancillary learning accessories. While the invention is illustrated and described in a preferred embodiment, the device may be produced in different sizes, combinations or configurations, forms, materials, and offered with a variety of learning accessories.

Figure 1A:
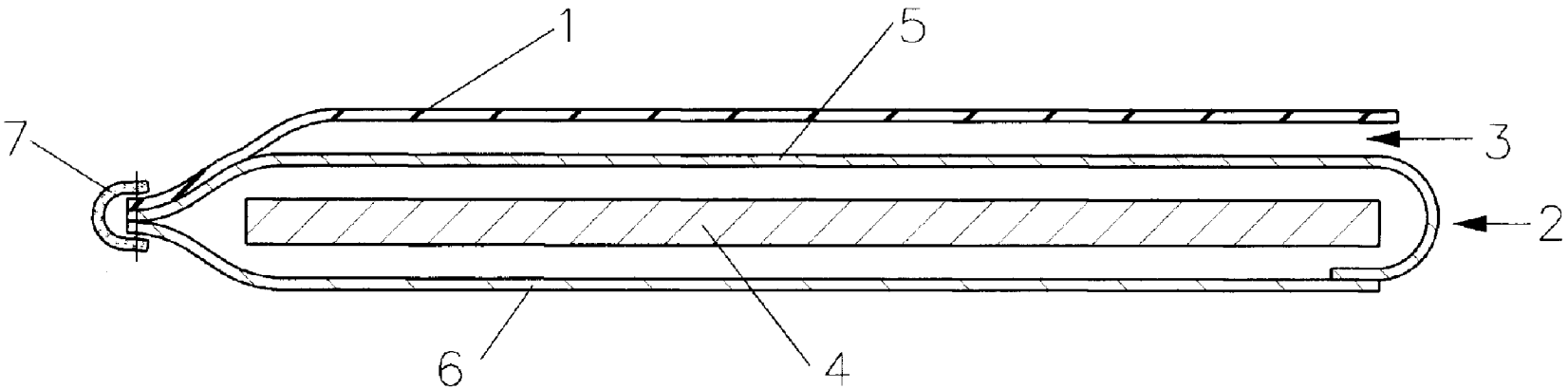
FIG. 1A is a cross section side view of the layers comprising the write-on wipe-off book holder

Referring to FIG. 1A, the write-on wipe-off book holder is comprised primarily of a top layer (1) and bottom composite layer (2). The top layer (1) is a single clear transparent layer of pliable vinyl while the bottom composite layer (2) is a fabric-encased board being formed by placing a flat rigid supporting board (4) between two pieces of fabric (5, 6) that are peripherally connected on all four edges. The board (4) can be of any flat rigid supporting material, slightly smaller in length and width than the fabric that encases it. The top (1) layer and bottom composite layer (2) are assembled and peripherally attached together on three sides. Although the preferred method of attachment is by means of machine stitching (i.e. thread), other means to those skilled in the art are applicable; such as adhesive glue or tape, heat bonding and the like. As shown in FIG. 1, the three attached edges may be finished with decorative trim edging (7) such as bias tape and the like. The fourth longer side remains unattached creating an opening (3). This opening (3) allows for the insertion of the underlying printed matter, which may be used as a guide while marking on the top clear transparent cover (1).

The present invention eliminates the need for mechanical clips to hold the underlying printed matter, in the form of either paper sheet material (i.e. worksheet, blank template, flash card) or a workbook, in place making it simple to use even by the youngest of children. The nature of the top vinyl material, in conjunction with the opposing pressure exerted from the attached bottom underlying rigid supporting board upon the inserted said printed paper matter, will act to grip and reversibly stick the said underlying printed form to the underside of the top transparent vinyl cover. The top cover surface of the invention being attached to the fabric-encased supporting board on three sides, is able to snugly hold said underlying printed matter in place void of any movement during the writing and erasing stages of use without the need for any mechanical means or hardware. Printed matter is simply inserted into the device by merely sliding said printed matter between the top cover and bottom board. It is then ready for use. This method of preparing and holding the underlying paper form is simple, quick, and very easy, especially for young children to use.

The nature, design, construction, and use of materials of the present invention also eliminates the need for mechanical moving parts to accommodate underlying printed matter in various forms of thickness. The write-on wipe-off book holder is able to accommodate both sheet like material (i.e. worksheet, blank template, flash card) or a workbook of varying thickness, free of any moving or mechanical parts. The top cover surface (1), being formed of pliable vinyl, is peripherally attached on three sides to the fabric (5, 6) that encases the bottom flat rigid supporting board (4). As such, this means of attachment to the fabric (5, 6), and not to the board (4) itself, allows for the opening (3) to remain adaptable enough to be able to receive a variety of workbooks of varying thickness in the open reading position, while the bottom surface (2) remains rigid enough to support a soft covered workbook.

Figure 2:
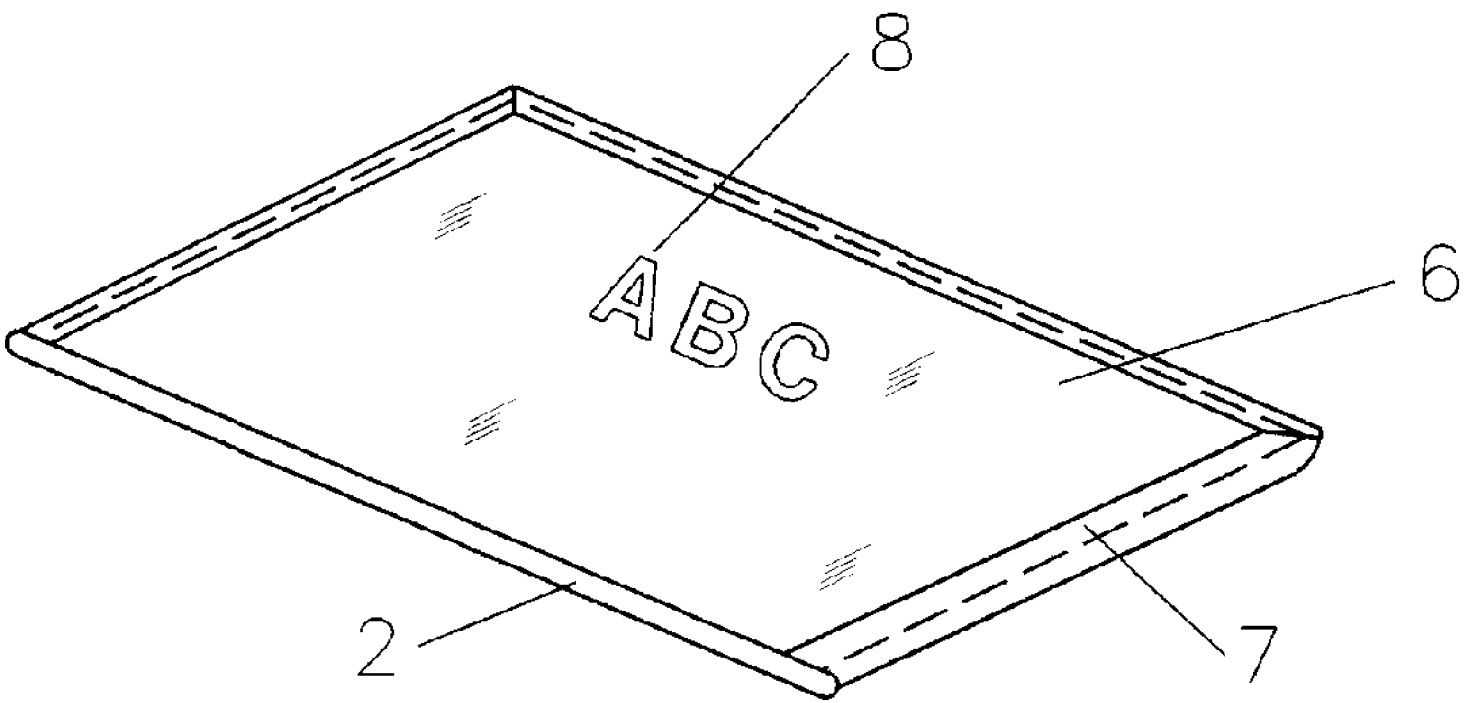
FIG. 2 depicts the reverse back side of the write-on wipe-off book holder, in the preferred embodiment, offering a secondary display panel in the form of a flannel felt board

In one preferred embodiment of the present invention, referring to FIG. 2, the fabric (6) of the encased flat rigid supporting board would comprise a self-adhering fabric, such as a non woven textile such as felt or the like. Use of such self-adhering fabric offers the reverse backside (FIG. 2) of the present device as an additional work or play surface commonly known as a flannel felt board; whereby children can create themes or stories by attaching self-adhering play pieces on the fabric play surface (6) or whereby teachers can present lessons by attaching self-adhering academia type pieces (i.e. letters, numbers, colors, shapes) (8) relating to a variety of subjects.

As used in this disclosure, a self-adhering fabric is meant to include such non-woven textiles as felt, stiffened felt, synthetic felt, 'pellon', and the like, since they posses the characteristic that felt-type fabric pieces (i.e., 'cut out' pieces in the shape of: characters, figures, letters, numbers, shapes, objects) reversibly attach to these surfaces upon light to moderate pressure.

In another embodiment of the present invention, the two pieces of fabric, that are used to encase the supporting board, are of contrasting color. Popular or preferred color choices for a felt flannel board are black, dark green, or bright blue. This would be the color of the bottom piece of fabric (6) that appears as the back side (FIG. 2) of the present invention. Using a light color fabric, such as white, on the topside (5) of the fabric encased supporting board (4) provides for an alternate use of the top clear transparent cover (1) of the present invention. Children could write and draw directly on the top cover surface (1) without any underlying paper guide such that the wipe-on wipe-off book holder (FIG. 1) could function as a conventional dry erase wipe-off or 'white' board.

In another embodiment of the present invention, said fabric would bear indicia corresponding to an educational subject that could be used as reference material or as an additional instructional aid. Such indicia on the front surface of the fabric (5) could serve as an underlying guide for writing on the top transparent cover of the present invention. Alternately, such indicia on the reverse backside fabric surface (6) of the present device would provide a secondary work or play display surface. Such examples include, but are not limited to: a lined handwriting guide, a number line, an analog clock face void of clock hands, a grid (representing graph paper), a musical staff, a story web, a Venn diagram, a hundreds chart, an incentive chart, a calendar or schedule, mathematical operants, common recreational games (i.e. tic-tac-toe grid, 'hang-man' framework) as well as arithmetic tables (i.e. multiplication, addition, subtraction), alphabet letters, alphabet letter and picture charts, handwriting stroke charts, color charts, or maps. Additional reversibly removable play pieces that relate to the fabric indicia, or to each other, could also be offered for use on the reverse backside surface of the present invention. Such manipulative play elements would be of a felt like material or contain one component of a hook and loop type fastener. Additionally, the manipulative elements could also contain surface indicia as well.

Alternatively, another such work or play surface could be in the form of transparent card holding strips for holding printed sheet like material whereby teachers or therapists can present training schedules, reinforcements, PECS (Picture Exchange Communication System), and the like using a variety of flash cards. The display board would include a plurality of cardholder strips that are transparent whereby the card is placed behind the cardholder strip so they can be seen. Said strips, being rectangular in shape and of the same length as the display panel, are attached to the edge of the panel at their shorter sides by means of machine stitching or by other means common to those skilled in the art. In addition, placing, a preferably unbreakable, mirror behind one such strip would form an alternate therapeutic surface.

Alternatively, another such work or play surface could be in the form of a 'hook and loop' display board for holding and displaying similar educational material. The 'hook and loop' display board would include a plurality of 'loops' whereby therapists could reversibly attach various objects that include one 'hook' component.

In use, a simple flip or rotation of the present teaching aid from the workbook lesson under the clear transparent top cover of the present device, to the secondary work, play, or therapeutic panel located on the reverse back side of the device permits alternate lesson presentations to the student. This is quick, easy, effective and alternate means of presenting a lesson, reinforcements, or PECS to a young child or student.

In another embodiment of the present invention, the flat rigid supporting board (4) would be magnetic. Use of such a magnetic board offers the reverse backside of the present device, an additional work or play surface, whereby children can attach magnetic play pieces (i.e. letters, numbers, shapes, or other academia type pieces) to the surface for recreational or educational purposes. Likewise, magnetic tokens as used in a 'token economy' reward system, could also be used for motivational purposes. Attachment of magnetic pieces is insured with the use of a lightweight fabric, such as broadcloth, for the supporting board encasement. Other materials and textiles also include vinyl, lightweight cotton, lightweight synthetic blends, as well as other textiles and materials that are commonly known to those skilled in the art.

In another embodiment, the present invention would also comprise of a marker holder such as a small fabric loop attached to the write-on wipe-off book holder for storing and holding a dry erase marker when not in use. The loop would be of approximately the same circumference as the marker so as to hold the marker securely in place. Other means for holding said marker can be a plastic marker clip holder, usually with adhesive backing which are commonly used in conjunction with marker boards, as well as other means that are commonly known to those skilled in the art.

In another embodiment, the present invention would also comprise of a carrying means, such as a handle, attached to the write-on wipe-off book holder for portability.

In another embodiment, the present invention would also comprise of a hanging means, such as an aperture formed therein, or a small loop attached to the write-on wipe-off book holder, for hanging on a wall or other vertical surface. Said loop being formed of fabric, string, rope, or a rope-like material, as well as other materials that are commonly known to those skilled in the art. Said aperture formed therein, for example, would comprise of at least one grommet or buttonhole. Hanging means, for example, would typically be positioned along the peripheral portion of the fabric surface of said fabric encased supporting board.

In another embodiment, the present invention would also comprise of a small removable storage pouch for storing markers, erasers, fabric play pieces and the like, where by the storage pouch could be opened and closed to hold appropriate items. In addition, said storage pouch could be attached and easily removed from the reverse back side of the said rigid flat supporting surface of said invention by fastening means, such as a hook and loop fastener. Other means for closing or for fastening the storage pouch to the backside of the present invention can be buttons, ties, interlocking snaps, and other means as are commonly known to those skilled in the art.

In other embodiments, ancillary accessories, alone or in combination, can be provided to compliment and offer the write-on wipe-off book holder as a learning kit. Such ancillary accessories may include at least one of the following: dry erase markers, wipe-off crayons, a dry erase eraser or a piece of appropriate cloth for erasing, a workbook, worksheets, package of blank templates, a table top easel display stand, attachable pre-cut fabric objects (i.e. characters, play figures, letters, numbers, shapes, objects) deemed self adhering and reversibly removable, removable storage pouches, and a separate carrying bag to store the present invention.

As used in this disclosure, "blank template" is meant to include printed sheet material that would be used in conjunction with the write-on wipe-off book holder as underlying paper guides. Each template would bear indicia corresponding to an instruction subject or recreational activity. Such templates would be void of certain indicia aspects such that a child would need to 'write in' and complete the template. One such example could be of the form of ruled handwriting paper. Ruled handwriting paper is known in various forms, and may include a different color baseline, a broken midline, and different sized ruling (i.e. 1⅛ inch ruling would be for Kindergarten). Children would be able view the handwriting template through the clear transparent cover of the present device and practice handwriting skills by writing on said cover with a dry erase maker. Other examples of such blank templates could include, but are not limited to: a number line, an analog clock face void of clock hands, a grid (representing graph paper), a musical staff, a story web, a Venn diagram, a hundreds chart, an incentive chart, a calendar or schedule, mathematical operants, and common recreational games (i.e. tic-tac-toe grid, 'hangman' framework).

Once the said printed matter is inserted into the device, it is ready for use whereby children can simply record their answers by writing on the clear transparent top side of the present invention utilizing any dry erase marker or wipe-off crayon.

When done, the student is able to wipe the clear transparent top cover clean using a cloth. The write-on wipe-off book holder is ready to use over and over again. The original printed matter (i.e. worksheet or book) remains protected and in tact. Additionally, the back reverse side of the present device offers a secondary play, work or therapeutic display surface.

It is apparent to those skilled in the art that the write-on wipe-off book holder can be further adapted within the scope of the invention. While a preferred embodiment of the invention has been described using specific terms, such description is for, illustrative purposes only, and it is to be understood that changes and variation may be made without departing from the spirit or scope of the following claims.

What is claimed is:

1. A reusable write-on wipe-off book holder teaching aid, comprising:

a top cover surface having four edges and being of a clear transparent material able to accept dry-erase markings or wipe-off crayon markings thereon and erasure therefrom;

a bottom rigid flat supporting surface, being a fabric encased board;

wherein the reverse back surface of said fabric encased board comprises a secondary planar work surface functionable as a display panel;

wherein said top and bottom surfaces are of approximately the same shape and size and peripherally connected together on three sides by means of machine stitching creating one unattached open side;

whereby said open side allows for insertion of printed matter, being of any length and of any width up to the fixed length and fixed width of said top cover surface, in the form of a child's workbook in the open reading position being of varying thickness or in the form of sheet material and;

whereby said top cover, being formed of a material such that it may be flexible enough to accommodate a variety of workbooks of varying thickness in the open reading position, and said top cover surface being formed of clear transparent pliable vinyl, and said vinyl being able to accept dry erase markings or wipe-off crayon markings thereon and erasure therefrom;

whereby said printed matter, is viewed through said top transparent cover surface and answers are recorded on said top transparent cover surface.

2. The write-on wipe-off book holder teaching aid of claim 1, wherein said display panel is selected from the group consisting of: a flannel board, a magnetic board, a surface having panel indicia, a surface having a plurality of hook or loop fasteners.

3. The write-on wipe-off book holder teaching aid of claim 1, wherein said display panel is selected from a combination of at least two of the group consisting of: a flannel board, a magnetic board, a surface having panel indicia, a surface having a plurality of hook or loop fasteners, a plurality of clear transparent card holding stips.

4. The write-on wipe-off book holder teaching aid of claim 1, comprising indicia on at least one fabric surface of said fabric encased board whereby said indicia on front side of said fabric encased board is viewed through said transparent cover and answers are recorded on said transparent cover.

5. The write-on wipe-off book holder teaching aid of claim 1, additionally comprising at least one underlying paper guide in the form of a blank template bearing indicia having a size slightly smaller than said open side whereby said template is viewed through said top transparent cover and answers are recorded on said top transparent cover surface.

6. The write-on wipe-off book holder teaching aid of claim 1, additionally comprising at least one play/instructional manipulative element that is reversibly adhering to said display panel.

7. The write-on wipe-off book holder teaching aid of claim 6, wherein said manipulative element comprises at least one component a non-hook-and-loop adhering fabric surface for contact to said display panel.

8. The write-on wipe-off book holder teaching aid of claim 6, wherein said manipulative element comprises one component of a hook and loop fastener system for contact to said display panel.

9. The write-on wipe-off book holder teaching aid of claim 6, wherein said manipulative element includes element indicia related to said display panel indicia.

10. A reusable write-on wipe-off book holder teaching aid, comprising:

a top cover surface having four edges and being of a clear transparent material able to accept dry-erase markings or wipe-off crayon markings thereon and erasure therefrom;

a bottom rigid flat supporting surface, being a fabric encased board;

wherein the reverse back surface of said fabric encased board comprises a secondary planar work surface functionable as a display panel to which play/instructional manipulative elements reversibly adhere;

wherein said top and bottom surfaces are of approximately the same shape and size and peripherally connected together on three sides by means of machine stitching creating one unattached open side;

whereby said open side allows for insertion of printed matter, being of any length and of any width up to the fixed length and fixed width of said top cover surface, in the form of a child's workbook in the open reading position being of varying thickness or in the form of sheet material and;

whereby said top cover, being formed of a material such that it may be flexible enough to accommodate a variety of workbooks of varying thickness in the open reading position, and said top cover surface being formed of clear transparent pliable vinyl, and said vinyl being able to accept dry erase markings or wipe-off crayon markings thereon and erasure therefrom;

whereby said printed matter, is viewed through said top transparent cover surface and answers are recorded on said top transparent cover surface.

11. The write-on wipe-off book holder teaching aid of claim 10, wherein said fabric encased board comprises a felt flannel fabric surface.

12. The write-on wipe-off book holder teaching aid of claim 10, wherein said fabric encased board comprises a plurality of a hook-and-loop fastener components attached to fabric surface.

13. The write-on wipe-off book holder teaching aid of claim 10, wherein said fabric encased board is magnetic.

14. The write-on wipe-off book holder teaching aid of claim 10, comprising indicia on at least one fabric surface of said fabric encased board whereby said indicia on front side of said fabric encased board is viewed through said top transparent cover and answers are recorded on said top transparent cover surface.

15. The write-on wipe-off book holder teaching aid of claim 10, additionally comprising at least one underlying paper guide in the form of a blank template bearing indicia having a size slightly smaller than said open side whereby said blank template is viewed through said top transparent cover and answers are recorded on said top transparent cover surface.

16. The write-on wipe-off book holder teaching aid of claim 10, additionally comprising at least one play/instructional manipulative element that is reversibly adhering to said display panel.

17. The write-on wipe-off book holder teaching aid of claim 10, additionally comprising a marker holding means for holding and storing said marker when not in use.

18. The write-on wipe-off book holder teaching aid of claim 14, additionally comprising at least one play/instructional manipulative element that is reversibly adhering to said display panel wherein said manipulative element includes element indicia related to said display panel indicia.

19. The write-on wipe-off book holder teaching aid of claim 16, wherein said manipulative element comprises at least one component a non-hook-and-loop adhering fabric surface for contact to said display panel.

20. The write-on wipe-off book holder teaching aid of claim 16, wherein said manipulative element comprises one component of a hook and loop fastener system for contact to said display panel.

* * * * *